United States Patent [19]

Arango

[11] Patent Number: 4,600,126

[45] Date of Patent: Jul. 15, 1986

[54] TOOTHPASTE EXTRACTOR

[75] Inventor: Aurelia Arango, Dade County, Fla.

[73] Assignee: Miguel A. Arango, Miami, Fla.

[21] Appl. No.: 655,752

[22] Filed: Oct. 1, 1984

Related U.S. Application Data

[63] Continuation-in-part of Ser. No. 6,459,390, Jan. 20, 1983, Pat. No. 4,508,240.

[51] Int. Cl.[4] ..... B67B 7/24

[52] U.S. Cl. ..... 222/82; 222/95; 222/209

[58] Field of Search ..... 222/76, 80, 394, 399, 222/401, 402, 400.5, 92, 94, 101, 371, 82, 81, 80, 209, 630, 631, 95, 206, 105

[56] References Cited

U.S. PATENT DOCUMENTS

| | | | |
|---|---|---|---|
| 1,841,275 | 1/1932 | Baptiste | 222/102 |
| 2,001,983 | 5/1935 | Spiros | 221/60 |
| 2,623,659 | 12/1952 | Gadelius | 222/80 |
| 2,634,026 | 4/1953 | Yuan | 222/82 |
| 2,792,856 | 5/1957 | Coppage | 141/362 |
| 3,417,902 | 12/1968 | Mirka | 222/96 |
| 4,234,104 | 11/1980 | Apuzzo | 222/94 |
| 4,508,239 | 4/1985 | Rozzen | 222/105 X |

*Primary Examiner*—Joseph J. Rolla
*Assistant Examiner*—Kenneth Noland
*Attorney, Agent, or Firm*—Jesus Sanchelima

[57] ABSTRACT

A toothpaste extractor or dispenser having a pneumatic pump connected to a syringe assembly that injects compressed air inside a toothpaste tube thereby urging the phase out through a nozzle positioned above a carrier assembly where the user's toothbrush is engaged. The user's force pushing the carrier in actuates, through a linking assembly, the pneumatic pump. All of these elements are mounted within a housing assembly.

5 Claims, 5 Drawing Figures

TOOTHPASTE EXTRACTOR

BACKGROUND OF THE INVENTION

1. Other Related Applications.

The present application is a continuation-in-part of pending application Ser. No. 06/459,390 filed 120-83, now U.S. Pat. No. 4,508,240.

2. Field of the Invention.

The present invention relates to a manually controllable toothpaste dispenser, and more particularly, to such devices which extract the paste or cream in predetermined amounts.

3. Description of the Prior Art.

A number of devices have been produced which use various methodologies for dispensing pastes, but none employ the novel concept of the present invention. The solution described herein is thought to be unique and novel and is expected to have a lower cost for its implementation than those devices in the prior art.

The present application differs from its parent application mainly in that it does not require an air tight chamber but rather the pneumatic pump injects the pressurized air in the toothpaste tube directly. This simplifies the extractor device and makes it more efficient with the consequent reduction in cost.

Other existing devices are described in U.S. Pat. Nos. 1,841,275; 3,417,902; 4,234,104; 2,001,983 and 2,623,659; which show the use of mechanical compression to extract paste from tubes. U.S. Pat. No. 2,792,856, discloses the use of negative air pressure in a two stroke device. None disclose the concept employed by the present invention which uses a pneumatic pump to create positive air pressure to urge paste from a tube.

Other patents describing the closest subject matter provide for a number of more or less complicated features that fail to solve the problem in an efficient and economical way. None of these patents suggest the novel features of the present invention.

SUMMARY OF THE INVENTION

It is the main object of the present invention to provide a paste extractor that is capable of dispensing a predetermined amount of toothpaste on a toothbrush without requiring the use of both hands by the user.

It is still another object of the present invention to provide a paste extractor that is inexpensive to manufacture, reliable and easy to maintain.

It is another object of the present invention to provide a dispenser that is clean and prevents contact from one toothbrush to the tube, thereby eliminating the transmission of bacteria.

It is another object of the present invention to provide a device that will easily squeeze out all the paste of a tube.

It is a further object of this invention to provide a novel method for tube paste extraction.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figures 1, 1A:
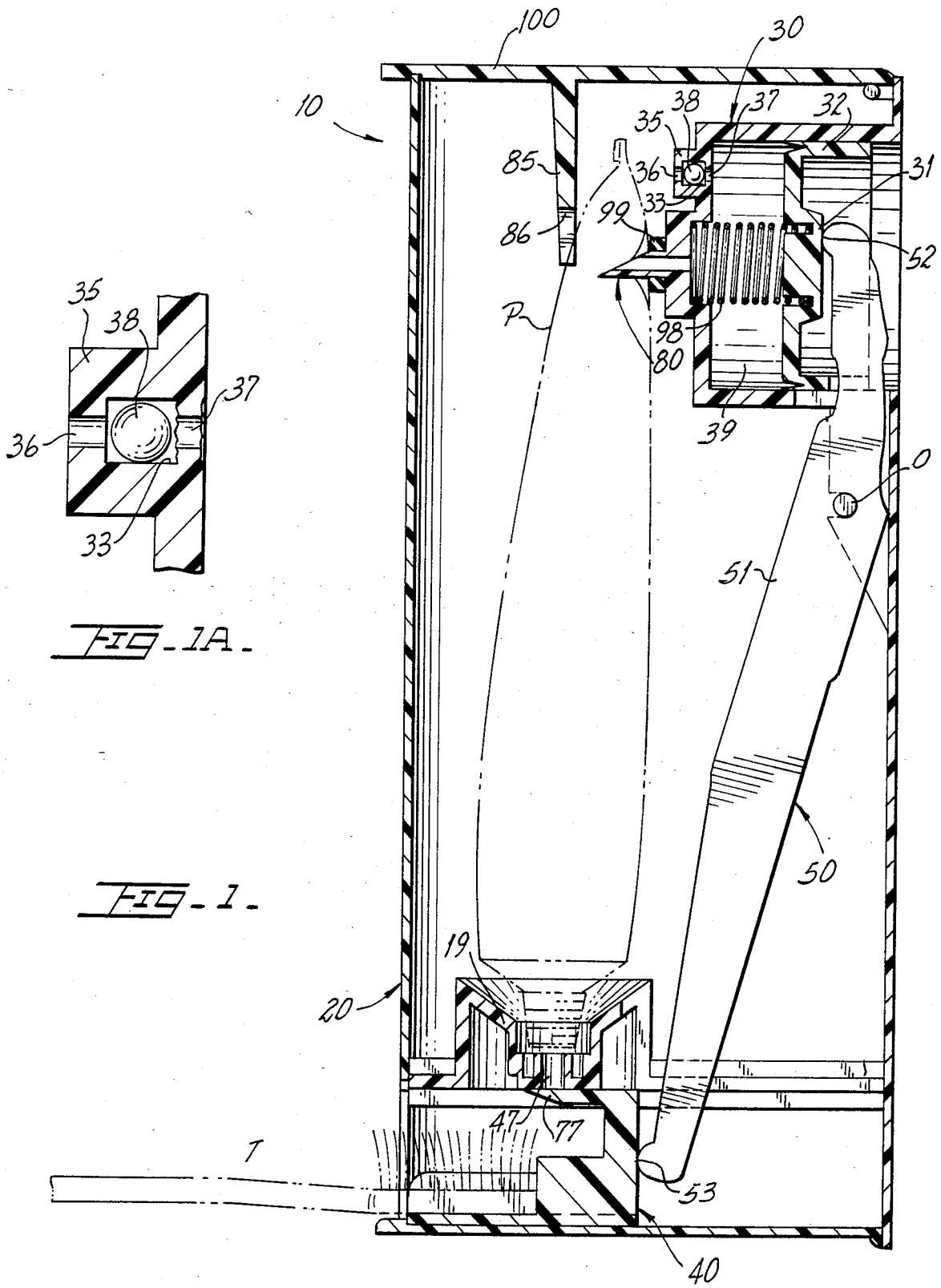
FIG. 1 depicts a cut-away side view of the preferred embodiment.
FIG. 1A illustrates a detailed view of the one-way valve utilized in the preferred embodiment.
Figure 2:
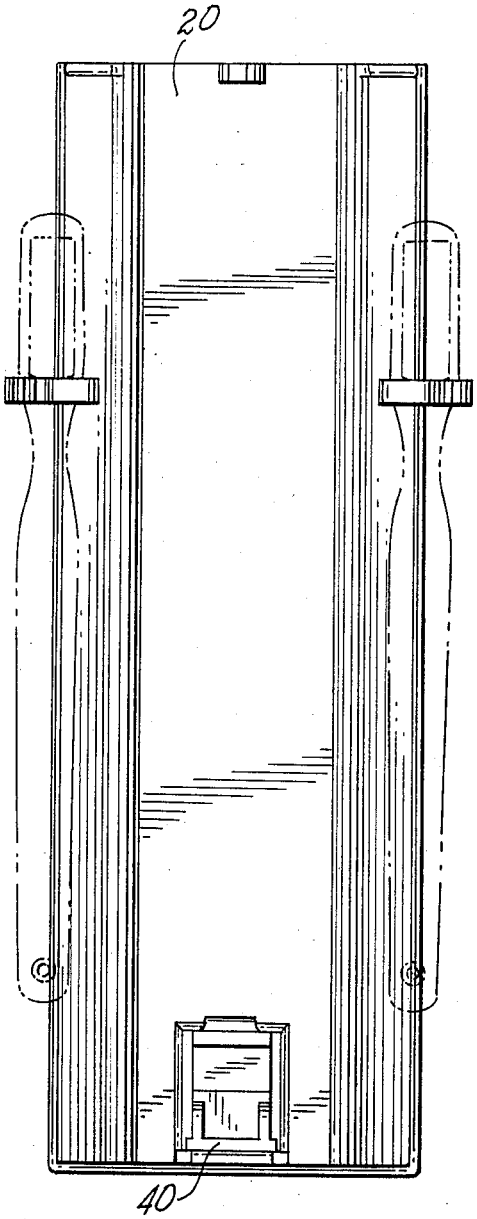
FIG. 2 shows a front view of hte present invention.
Figure 3:
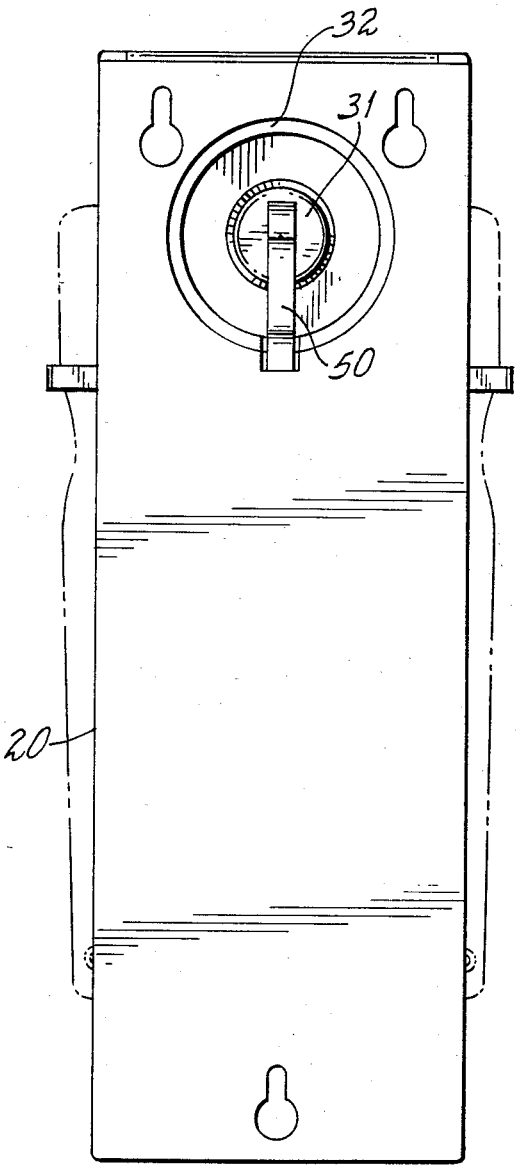
FIG. 3 represents a back view of this invention.
Figure 4:
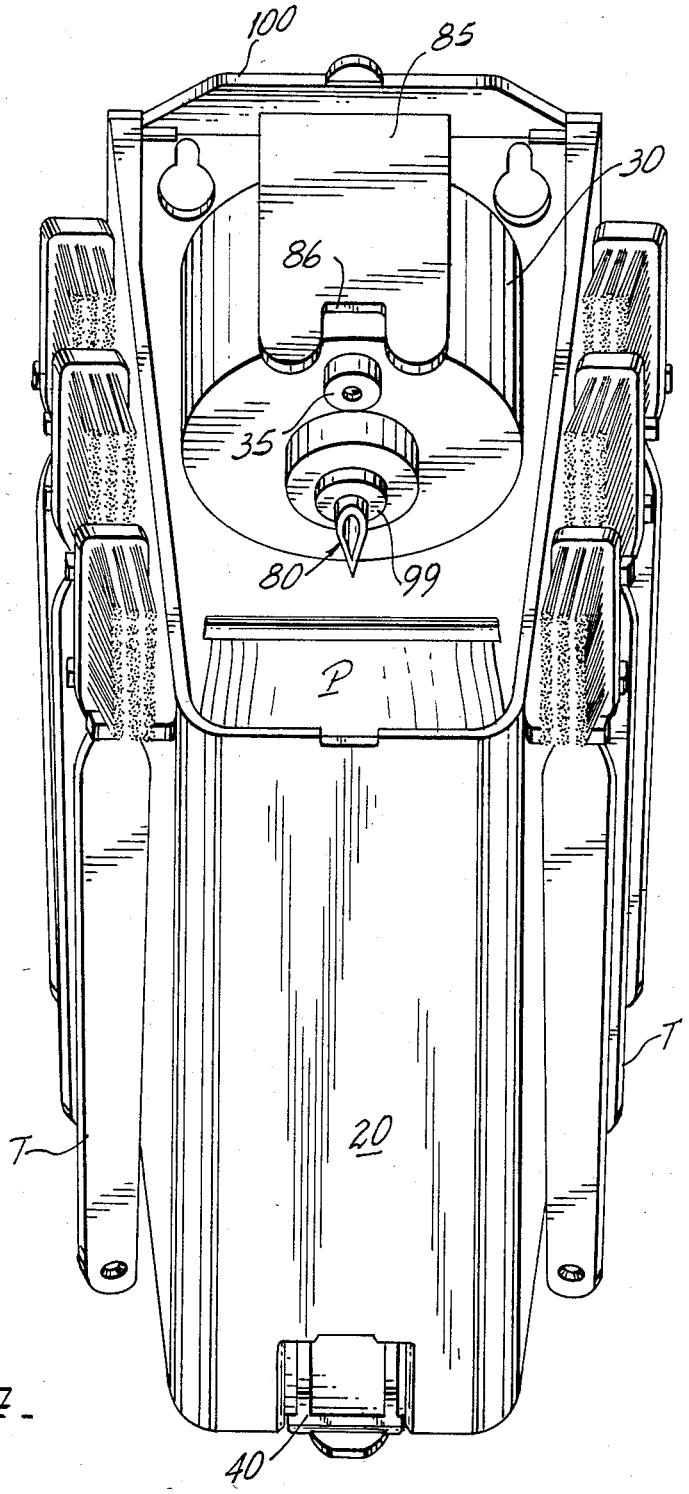
FIG. 4 is an inclined view, from the top, having the cover open.

Referring now to FIG. 1, the present invention is generally referred to with numeral 10. In general it comprises a housing assembly 20, a pneumatic assembly 30, a carrier assembly 40, linkage assembly 50 and syringe assembly 80. The user inserts toothbrush T inside carrier assembly 40 which is designed to accept commercially available toothbrushes. Carrier assembly 40 is engaged to one end 53 of elongated arm 51 of spring loaded linkage assembly 50 so it is urged towards the front of housing assembly 20. Carrier assembly 40 transmits the motion imparted by the user to linkage assembly 50 which, in the preferred embodiment is contained within housing assembly 20. Linkage assembly 50 pivots around point 0 and it is, in the preferred embodiment a substantially elongated arm 51 having end 52 abutting to pump actuator 31 on piston 32 in pneumatic assembly 30. Pneumatic assembly 30 is basically an air pump with a one-way valve 35 and spring 98. One-way valve 35 in the preferred embodiment is a small metal ball 38, like a BB captured inside compartment 33 that seals opening 36 when piston 32 compresses air inside cylinder chamber 39. When piston 32 moves the other way, however, air is allowed in through imperfect opening 37 which is small enough to prevent ball 38 from falling out. The reason for being an imperfect opening is to let air inside cylinder chamber 39. This way the air is forced out of chamber 39 through syringe assembly 80 and allowed in through one-way valve 35.

Holder 85 is rigidly mounted to or formed on hingedly mounted cover 100. Holder 85 is designed to provide a support point for pushing tube P towards syringe assembly 80 when cover 100 is closed. Holder 85 has clearance 86 which allows a small deflection on the tube P when syringe tip 81 penetrates through the tube P go through the opposite wall of tube P. The air forced out through syringe assembly 85 is compressed inside tube P thereby pushing the paste downwardly.

When toothpaste tube P is inserted inside housing assembly 20 it rests on collar 19 which is positioned above carrier assembly 40. Collar 19 terminates in nozzle 47 which is aligned with the opening of toothpaste tube P. Nozzle 47 is obstructed by cutting piece 77, which is rigidly mounted to or formed on carrier assembly 40, when no force is exerted by the user on toothbrush T. When nozzle 47 is obstructed no paste can be dispensed. When carrier assembly 40, and consequently, cutting piece 77 is moved inwardly, nozzle 47 is opened thereby allowing dispensing of a certain amount of paste on toothbrush T.

A rubber washer 99 surrounds the base of syringe assembly 80 so that when the latter penetrates inside tube P, washer 99 is pushed against the wall of tube P thereby sealing the interface between the wall and syringe assembly 80.

It is believed the foregoing description conveys the best understanding of the objects and advantages of the present invention. Different embodiments may be made of the inventive concept of this invention. It is to be understood that all matter disclosed herein is to be interpreted merely as illustrative, and not in a limiting sense, except as set forth in the following appended claims.

What is claimed is:

1. A dispenser of the toothpaste from a tube, manually operated by a user by inserting a toothbrush, comprising, in operative combination:

A. a housing having a collar seat for said tube and a nozzle in alignment with the opening of said tube;

B. pneumatic means for compressing air mounted within said housing and including a one-way valve and syringe means adapted to penetrate said tube so that air is allowed inside said pneumatic means through said valve and injected out through said syringe means and inside said tube when said pneumatic means is activated;

C. carrier means slidably mounted within said housing and adapted to receive said toothbrush;

D. linkage means for transmitting the motion applied on said carrier means by the user through said toothbrush to actuate said pneumatic means so that compressed air is injected inside said tube thereby forcing a predetermined amount of toothpaste out through said nozzle and deposited on said toothbrush.

2. The device set forth in claim 1 wherein said housing includes a hingedly mounted cover including a holder element that is rigidly mounted thereon and adapted to push said tube towards said syringe assembly when said cover is closed.

3. The device set forth in claim 2 wherein said one-way valve includes an assembly having a compartment containing a metal ball therein and an opening connecting said compartment with the interior of the cylinder chamber said pneumatic means and another opening connecting said compartment with the exterior so that the compressed air is forced out through said syringe assembly only and admitted through said openings only.

4. The device set forth in claim 3 wherein said carrier means include a cutting piece mounted thereon and adapted to open and close said nozzle as said carrier is moved in and out.

5. The device set forth in claim 4 wherein said syringe means includes a rubber washer.

* * * * *